US007890026B2

(12) United States Patent
Naruge

(10) Patent No.: US 7,890,026 B2
(45) Date of Patent: Feb. 15, 2011

(54) DEVELOPMENT APPARATUS AND IMAGE FORMING APPARATUS

(75) Inventor: Shoji Naruge, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 12/144,817

(22) Filed: Jun. 24, 2008

(65) Prior Publication Data

US 2009/0016775 A1 Jan. 15, 2009

(30) Foreign Application Priority Data

Jul. 13, 2007 (JP) ..... 2007-184588

(51) Int. Cl.
*G03G 15/08* (2006.01)

(52) U.S. Cl. ..... 399/222; 399/53

(58) Field of Classification Search ..... 399/222, 399/53, 119

See application file for complete search history.

(56) References Cited

U.S. PATENT DOCUMENTS 6,067,433 A 5/2000 Kimura et al.
2006/0099009 A1* 5/2006 Miyamoto et al. ..... 399/119

FOREIGN PATENT DOCUMENTS

JP 11-194617 A 7/1999
JP 2000-206792 A 7/2000

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

When dynamic torques are Ts, Ti, and T2, respectively, and rotation angle speeds are Rs, R1, and R2, respectively, at the time of rotations of the developing sleeve 40 and the screws 41 and 42, the mass of the developer housed in the second agitating chamber 902 is M2, the mass of the developer which is present in the space of the side of the developing sleeve when a space formed by the developing chamber 900 and the first agitating chamber 901 is divided is Ms, the mass of the developer which is present in the space of the side of the screw 41 is M1, gravitational acceleration is G, each load on the developer by rotations of the developing sleeve and the screws is defined as Wds (mW/g)=Rs×Ts×G/Ms, Wd1(mW/g)=R1×T1×G/M1, and Wd2 (mW/g)=R2×T2×G/M2, respectively, relationships of $0.5<Wds/(Wd1+Wd2)\leqq 7.0$, $12.5\leqq Wds\leqq 57.5$, and $Wd1<Wd2$ are satisfied.

3 Claims, 9 Drawing Sheets

*FIG. 5*

| | | | Wds | | | | | | | | |
|---|---|---|---|---|---|---|---|---|---|---|---|
| CONDITION | Wd1 | Wd2 | 10 | 12.5 | 15 | 20 | 35 | 50 | 55 | 57.5 | 60 |
| 1-1 | 1.0 | 0.5 | □6.7 | ×8.3 | ×10 | ×13.3 | ×23.3 | ×33.3 | ×36.7 | ×38.3 | ×△40 |
| 1-2 | 1.0 | 1.0 | □5 | ×6.3 | ×7.5 | ×10 | ×17.5 | ×25 | ×27.5 | ×28.8 | ×△30 |
| 1-3 | 1.0 | 1.5 | □4 | ◎5 | ◎6 | ×8 | ×14 | ×20 | ×22 | ×23 | ×△24 |
| 1-4 | 1.0 | 2.0 | □3.3 | ◎4.2 | ◎5 | ◎6.7 | ×11.7 | ×16.7 | ×18.3 | ×19.2 | ×△20 |
| 1-5 | 1.0 | 2.5 | □2.9 | ◎3.6 | ◎4.3 | ◎5.7 | ×10 | ×14.3 | ×15.7 | ×16.4 | ×△17.1 |
| 1-6 | 1.0 | 5.5 | □1.5 | ◎1.9 | ◎2.3 | ◎3.1 | ◎5.4 | ×7.7 | ×8.5 | ×8.8 | ×△9.2 |
| 1-7 | 1.0 | 10.0 | □0.9 | ◎1.5 | ◎1.4 | ◎1.8 | ◎3.2 | ◎4.5 | ◎5 | ◎6.7 | △5.5 |
| 1-8 | 1.0 | 15.0 | □0.6 | ◎0.8 | ◎0.9 | ◎1.3 | ◎2.2 | ◎3.1 | ◎3.4 | ◎3.7 | △3.8 |
| 1-9 | 2.0 | 3.0 | □2 | ◎2.5 | ◎3 | ◎4 | ◎7 | ×10 | ×11 | ×11.5 | ×△12 |
| 1-10 | 3.0 | 4.0 | □1.4 | ◎1.8 | ◎2.1 | ◎2.9 | ◎5 | ×7.1 | ×7.9 | ×8.2 | ×△8.6 |
| 1-11 | 5.0 | 6.0 | □0.9 | ◎1.1 | ◎1.4 | ◎1.8 | ◎3.2 | ◎4.5 | ◎5 | ◎5.2 | △5.5 |
| 1-12 | 7.0 | 8.0 | □0.7 | ◎0.8 | ◎1 | ◎1.3 | ◎2.3 | ◎3.3 | ◎3.7 | ◎3.8 | △4 |
| 1-13 | 14.0 | 15.0 | / | / | ◎0.6 | ◎0.7 | ◎1.2 | ◎1.7 | ◎1.9 | ◎2 | △2.1 |
| 1-14 | 3.0 | 2.0 | □2 | ×2.5 | ×3 | ×4 | ×7 | ×10 | ×11 | ×11.5 | ×△12 |
| 1-15 | 4.0 | 3.0 | □1.4 | ×1.8 | ×2.1 | ×2.9 | ×5 | ×7.1 | ×7.9 | ×8.2 | ×△8.6 |
| 1-16 | 6.0 | 5.0 | □0.9 | ×1.1 | ×1.4 | ×1.8 | ×3.2 | ×4.5 | ×5 | ×5.2 | ×△5.5 |
| 1-17 | 8.0 | 7.0 | □0.7 | ×0.8 | ×1 | ×1.3 | ×2.3 | ×3.3 | ×3.7 | ×3.8 | ×△4 |
| 1-18 | 15.0 | 14.0 | / | / | ×0.6 | ×0.7 | ×1.2 | ×1.7 | ×1.9 | ×2 | ×△2.1 |
| 1-19 | 28.0 | 27.0 | / | / | / | / | ×0.6 | ×0.9 | ×1 | 1.0 | ×△1.1 |
| 1-20 | 28.0 | 28.0 | / | / | / | / | ×0.6 | ×0.9 | ×1 | 1.0 | ×△1.1 |
| 1-21 | 28.0 | 29.0 | / | / | / | / | ◎0.6 | ◎0.9 | ◎1 | ◎1 | △1.1 |
| 1-22 | 28.0 | 30.0 | / | / | / | / | ◎0.6 | ◎0.9 | ◎0.9 | ◎1 | △1 |

THE NUMBERS SHOW THE VALUES OF Wds/(Wd1+Wd2)

EXPLANATION OF SYMBOLS

◎ • • • GOOD IMAGE

× • • • GENERATION OF SCREW PITCH UNEVENNESS

△ • • • GENERATION OF FOG AT THE TIME OF DURABILITY

□ • • • POOR DEVELOPING SLEEVE COATING

/ • • • NO DATA

*FIG. 8*

| THE NUMBER OF SHEETS HAVING DURABILITY | 10000 | 20000 | 30000 | 40000 | 50000 |
|---|---|---|---|---|---|
| WITHOUT THE MAGNETIC FIELD GENERATING UNIT | ◎ | ◎ | ◎ | × | × |
| WITH THE MAGNETIC FIELD GENERATING UNIT | ◎ | ◎ | ◎ | ◎ | ◎ |

DESCRIPTION OF SYMBOLS

◎ ▪ ▪ ▪ ▪ GOOD IMAGE

× ▪ ▪ ▪ ▪ GENERATION OF FOG AT THE TIME OF DURABILITY

DEVELOPMENT APPARATUS AND IMAGE FORMING APPARATUS

BACKGROUND OF THE INVENTION

1. Field of the Invention

The present invention relates to a development apparatus which develops an electrostatic image formed in an image bearing member with a developer, a copying machine having the same, and an image forming apparatus such as a laser beam printer and a facsimile.

2. Description of the Related Art

With reference to electrophotographic apparatuses, a development apparatus with a magnetic brush developing system which uses a two-component developer containing toner particles and a magnetic carrier has been widely used.

The developing process will be described with reference to FIG. 9. In FIG. 9, a magnet roller 45 is fixedly disposed in a developing sleeve 40, agitating screws 41 and 42 can agitate, a control blade 43 is placed on the surface of the developing sleeve in order to form a thin layer of a developer, and a developing container 44 is a container.

The agitating screws 41 and 42 convey the developer in the opposite direction each other and the developer is passed from one agitating screw to the other at both ends. As a whole, it is conveyed so as to be circulated in one direction.

The developer pumped by a N2 pole in accordance with the rotation of the developing sleeve 40 is regulated by a control blade 43 in the process of conveyance from a S2 pole to a N1 pole and then a thin layer is formed on the developing sleeve 40. When the developer in which a thin layer is formed is conveyed to a S1 pole which is a developing main pole at the time, a spike-like shape of the developer is formed by a magnetic force. The electrostatic image is developed by the spike-like shape of the developer and then the developer on the developing sleeve 40 is returned to a developing container 44 by the repulsive magnetic field of a N3 pole and the N2 pole. With reference to the two-component development, generally, homopolar magnetic poles are arranged and disposed as described above and the developer after the development is once released from the developing sleeve not to leave an image history.

In recent years, the miniaturization, high-quality image, and long-life technologies for the development apparatus and the image forming apparatus using a two-component development device have been developed. In order to ensure the long life of development apparatus, it is necessary to reduce the load on the developer and prevent the degradation of toner and carrier.

The location in which the load is applied to the developer in the developing container is a developer layer thickness regulating portion. In a usual structure, the developer layer thickness regulation pole is located upstream of rotational direction of the developing sleeve 40 rather than the control blade 43. The developer drawn to the developer layer thickness regulation pole in the region is compressed between the developing sleeve 40 and the container.

Specific methods which reduce the load on the developer in the developing sleeve 40 in order to ensure a long life of the developer are disclosed in Japanese Patent Application Laid-Open Nos. 11-194617 and 2000-206792. These methods involve the steps of reducing the magnetic field strength in a direction perpendicular to the surface of the developing sleeve 40, decreasing the amount of magnetization of carrier, using one of the repulsive magnetic poles as the developer layer thickness regulation pole, and reducing the amount of the developer drawn to the developer layer thickness regulation pole.

However, the screw-pitch shaped density unevenness may be generated in a black-colored image in the case where the compression of the developer in the developing sleeve 40 is weakened.

The phenomenon is caused by the result that when the developer is supplied to the developer layer thickness regulation pole by rotation of the screw 41 in the vicinity of the developing sleeve 40 with unevenness in the toner electrification amount Q/M, the developer is conveyed to the developing portion as it is. Such a phenomenon is easily generated, particularly when a degree of the compression of the developer in the developer layer thickness regulation pole is reduced.

SUMMARY OF THE INVENTION

The present invention was achieved in view of the above circumstances. For the purpose of giving the developer a longer life, the present invention provides a development apparatus and an image forming apparatus which can eliminate screw pitch unevenness of a black-colored portion even when the compression in a developer bearing member is weakened.

The present invention provides the image forming apparatus which includes;

an image bearing member which bears an image;

a development apparatus which develops a latent image formed on the image bearing member as a toner image; the development apparatus having;

a developing container having a first chamber and a second chamber which communicates with the first chamber and to which a developer to be fed is supplied;

a developer bearing member which is rotatably provided in the first chamber and feeds the developer to the image bearing member; and a first conveying member which is rotatably provided in the first chamber and conveys the developer in the first chamber;

a second conveying member which is rotatably provided in the second chamber and conveys the developer in the second chamber to the first chamber;

wherein when dynamic torcues (gf·m) are Ts, T1, and T2, respectively, and rotation angle speeds (rad/s) are Rs, R1, and R2, respectively, at the time of rotations of the developer bearing member, the first conveying member, and the second conveying member the mass (g) of the developer housed in the second chamber is M2, the mass (g) of the developer which is present in a space of a side of the developer bearing member is Ms, when the first chamber is divided by a perpendicular bisector which bisects a line segment connecting two points, wherein the two points are intersection points at which a line segment connecting a shaft center of the developer bearing member and a shaft center of the first conveying member intersects with an outer diameter of the developer bearing member and an outer diameter of the first conveying member, the mass (g) of the developer which is present in a space of a side of the first conveying member is M1 when the first chamber is divided by the perpendicular bisector, gravitational acceleration ($m/s^2$) is G, each load on the developer conveyed by rotations of the developer bearing member, the first conveying member, and the second conveying member is defined as $Wds(mW/g)=Rs\times Ts\times G/Ms$, $Wd1(mW/g)=R1\times T1\times G/M1$, and $Wd2(mW/g)=R2\times T2\times G/M2$, respectively, relationships of $0.5<Wds/(Wd1+Wd2)\leqq 7.0$, $12.5\leqq Wds\leqq 57.5$, and $Wd1<Wd2$ are satisfied.

Further features of the present invention will become apparent from the following description of exemplary embodiments with reference to the attached drawings.

BRIEF DESCRIPTION OF THE DRAWINGS

FIG. 5 is a diagram illustrating results when Wd1, Wd2, and Wds are changed;

FIG. 8 is a diagram illustrating results of fog generation when the magnetic field generating unit is provided or not provided directly below an agitating and conveying screw.

DESCRIPTION OF THE EMBODIMENTS

Subsequently, the development apparatus according to one embodiment of the present invention and the image forming apparatus having the same will be described with reference to the drawings.

First Embodiment (The Entire Structure of the Image Forming Apparatus)

Figure 1:
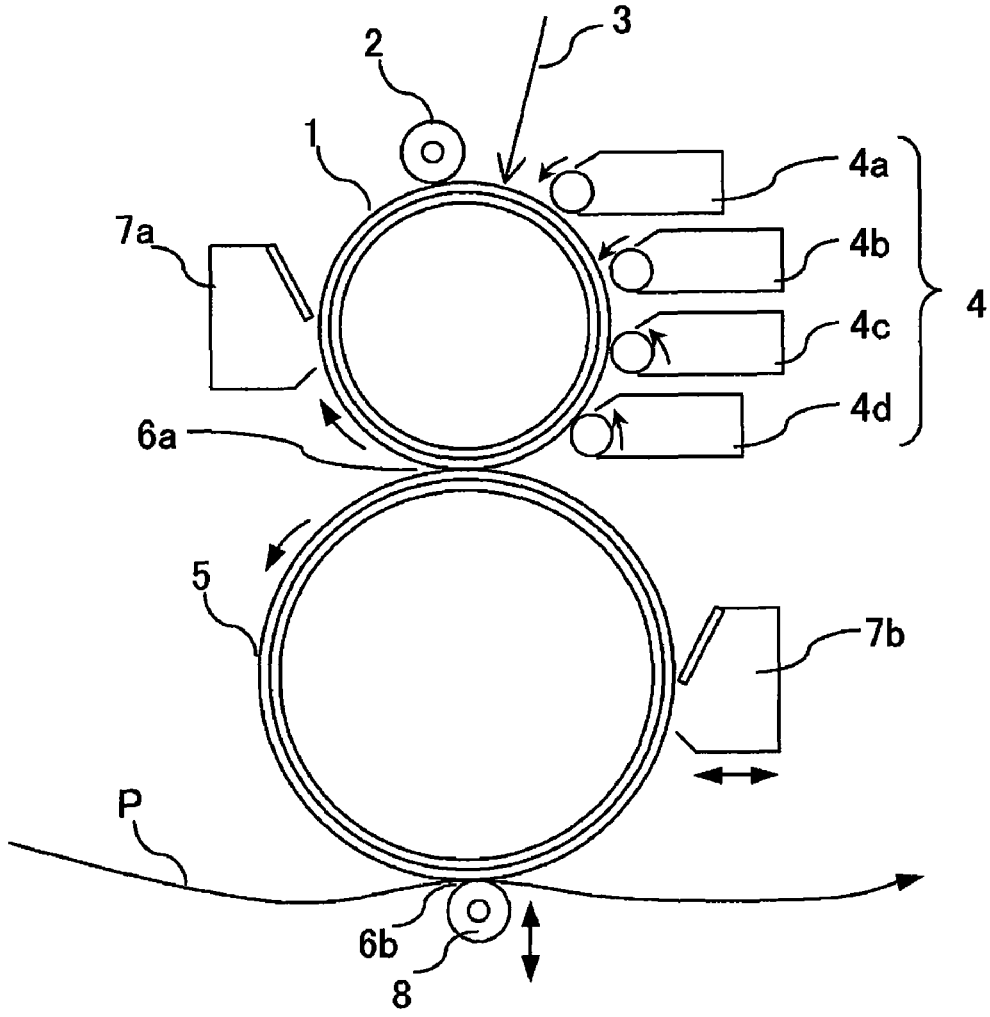
FIG. 1 is a schematic view illustrating an image forming apparatus in which a development apparatus according to a first embodiment is installed.

First, the entire structure of the image forming apparatus and the image forming operation will be described with reference to FIG. 1. FIG. 1 is an explanatory schematic diagram of the mage forming apparatus having the development apparatus of the embodiment.

In FIG. 1, a photosensitive drum 1 is used as an image bearing member and the photosensitive drum 1 includes photosensitive layers, such as OPC, amorphous Se, and amorphous S1 which are formed on the peripheral surface of a base member of a cylinder made of metal, such as aluminum and nickel. The photosensitive drum 1 is rotated and driven in the direction of an arrow in FIG. 1 at a predetermined circumferential speed. In the rotation process, the surface of the drum is uniformly charged to a dark part potential (VD)−700V by a charging roller 2 which is a charging apparatus. Then, the surface of the photosensitive drum 1 is scanning-exposed to a laser beam 3 which is controlled by an ON-OFF system in response to an image information of the first color. An electrostatic image of the first color is formed on the surface of the photosensitive drum 1 at a light part potential (VL)−100V.

The electrostatic image thus formed is developed by a development apparatus 4 and it is visualized as a toner image. The first to fourth development apparatuses 4*a*, 4*b*, 4*c*, and 4*d* in which toners of four colors, namely, yellow, magenta, cyan, and black are included are installed in the development apparatus 4. The electrostatic image is developed by the first development apparatus 4*a* and a yellow toner image is formed as the first color. As a developing method, image exposure and reversal development are used in combination.

A yellow toner image of the first color is electrostatically-transferred to the surface of an intermediate transfer member 5 at a first transfer portion 6*a* in contact with the photosensitive drum 1 by applying an opposite-polarity voltage to the charging polarity of toner from a high voltage power supply, not shown, (primary transfer). The intermediate transfer member 5 has a peripheral length slightly longer than the length of a recording material. The intermediate transfer member 5 is welded with a predetermined pressure on the photosensitive drum 1 and rotated and driven in the direction of an arrow in FIG. 1 at a circumferential speed nearly equal to that of the photosensitive drum 1. The toner remained on the surface of the photosensitive drum 1 after the primary transfer is removed by a cleaning apparatus 7*a*.

The process is further repeated 3 times and then electrostatic images of magenta, cyan, and black which are sequentially formed on the surface of the photosensitive drum 1 are respectively developed by the second to fourth development apparatuses 4*b*, 4*c*, and 4*d*. The obtained toner images are transferred onto the intermediate transfer member 5. Thus, a color image layered with toner images having four colors of yellow, magenta, cyan, and black is formed on the intermediate transfer member 5.

Thereafter, the color image on the intermediate transfer member 5 is collectively transferred to the surface of a recording material P which is conveyed from a second transfer portion 6*b* in contact with the intermediate transfer member 5 by applying an opposite-polarity voltage to the charging polarity of toner to a secondary transfer roller 8 (secondary transfer).

The secondary transfer roller 8 is separated from the intermediate transfer member 5. At the time of secondary transfer, the secondary transfer roller 8 is welded to the surface of the intermediate transfer member 5 with a predetermined pressure and they come into contact with each other. The transfer roller 8 is rotated by following rotation or drive rotation.

The recording material P to which the color images are transferred is sent to a fixed apparatus (not shown). Then, the color images are fixed to the recording material P by heating. After producing a permanent image, the recording material P is discharged to the outside of the image forming apparatus. The toner remained on the surface of the intermediate transfer member 5 after the secondary transfer is removed by a cleaning apparatus 7*b* which is in an operating state to the intermediate transfer member 5 at a predetermined timing.

(Development Apparatus)

Subsequently, the structure of the development apparatus 4 according to the embodiment (development apparatuses 4*a* to 4*d*) will be described with reference to FIG. 2.

The development apparatus 4 includes a developing chamber 900 in a developing container 44, a first agitating chamber 901 which is communicated with the developing chamber 900 so as to be almost combined together. The second agitating chamber 902 is communicated with the first agitating chamber 901 and both chambers are divided by a regulation wall. Here, the first chamber is a combination of the developing chamber 900 and the first agitating chamber 901. The second agitating chamber 902 is the second chamber.

Further, the developing sleeve 40 that is a rotatable developer bearing member is provided in the developing chamber 900 in order to supply the developer to the photosensitive drum 1. As shown in FIG. 2, the magnetized magnet roller 45 (magnetic field generating unit) is fixedly disposed in the developing sleeve 40.

Further, a first agitating and conveying screw 41 which is a rotatable first conveying member is provided in the first agitating chamber 901 in order to agitate the developer in the first chamber, convey it to the developing chamber 900, and supply it to the developing sleeve 40. In the same manner as described above, a second agitating and conveying screw 42 which is a rotatable second conveying member is provided in the second agitating chamber 902 in order to agitate the developer in the second chamber and convey it to the first agitating chamber 901. The developer to be fed is supplied to the second agitating chamber 902. Both longitudinal ends of the first agitating chamber and the second agitating chamber are communicated and the developer circulates between the first agitating chamber and the second agitating chamber.

A two-component developer containing a nonmagnetic toner and a magnetic carrier is housed in the developing container 44. The two-component developer is present in the first agitating chamber 901 and the second agitating chamber 902 which are divided by the regulation wall. When the agitating and conveying screws 41 and 42 rotate, the developer in the second agitating chamber 902 is conveyed by the first agitating chamber 901 while the developer is agitated. Further, the developer in the first agitating chamber 901 is supplied to the developing sleeve 40 in the developing chamber 900 while the developer is agitated.

Then developer pumped to the developing sleeve 40 by the magnetic force of the magnet roller 45 is regulated by the control blade 43 in accordance with the rotation of the developing sleeve 40. Then, a thin layer is formed on the developing sleeve 40 and an electrostatic image of the photosensitive drum 1 is developed.

The developer in which the toner is consumed on the developing sleeve 40 and the toner concentration is decreased is conveyed in the developing chamber and then flown into the agitating chamber. The supplied toner is uniformly dispersed while it is agitated and conveyed with the developer having the decreased toner concentration in the agitating chamber.

Among the magnetic poles of the developing sleeve 40, the S3 which is one of the S3 pole and the S1 pole which form the repulsive magnetic field is used as a developer layer thickness regulation pole and the S1 pole is used as a developer releasing pole. It is preferable that a peak value of the magnetic field strength in a direction perpendicular to the surface of the developing sleeve 40 of the S3 pole is 400 gauss or more and 1,000 gauss or less and a peak value of the magnetic field strength in a direction perpendicular to the surface of the developing sleeve 40 of the S1 pole is 400 gauss or more and 800 gauss or less.

In the embodiment, a peak value of the magnetic field strength of the S3 pole is 600 gauss and a peak value of the magnetic field strength of the S1 pole is 500 gauss. Further, positions of the S3 pole and the S1 pole on developing sleeve 40 is as follows. That is, a peak position of the magnetic field strength in a direction perpendicular to the surface of the developing sleeve of the developer releasing S1 pole is located in the upper part, in a direction of gravitational force, of a peak position of the magnetic field strength in a direction perpendicular to the surface of the developing sleeve of the developer layer thickness regulation pole S3.

When such a structure is used, the developer after the development easily falls. Thus, it is not necessary to have a particular releasing unit. Further, the developer is adhered by the magnetic suction force of the developer layer thickness regulation pole and it is easy to convey to the developing portion. In other words, it is easy to release the developer from the developing sleeve 40 and supply the developer to the developing sleeve 40.

In the embodiment, the peak position of the magnetic field strength in a direction perpendicular to the surface of the developing sleeve of the pole S3 and the edge (developing sleeve side) of the control blade (control member) 43 are 5° (based on a center position of the developing sleeve 40).

Since the S3 pole forms the repulsive magnetic field between the S3 pole and the S1 pole, magnetic lines of force of the S3 pole tend to be emitted in a direction perpendicular to the developing sleeve 40. As a result, changes in the magnetic field (density of magnetic lines of force) in a direction perpendicular to the developing sleeve are reduced. The result corresponds to the face that the force drawing the developer to the developing sleeve 40 is decreased. When such a structure is used, the force which compresses the developer in the developer layer thickness regulation pole becomes weaker. The deteriorations in the developer such as deteriorated toner and spent carrier are suppressed and the lifetime of the developer is extended.

(Structure to Prevent the Screw-pitch Shaped Density Unevenness)

Here, when the structure which reduces the load on the developer in the developing sleeve 40 is used, the screw-pitch shaped density unevenness may be generated at the edge of the black-colored image. This phenomenon is generated by the following conditions:

the developer conveyed by the agitating and conveying screws 41 and 42 is not sufficiently charged and flown into the developing chamber;

the difference between the toner originally existing in the developing chamber and the toner electrification amount Q/M is produced; and the developer is pumped to the developing sleeve and supplied to the developing pole.

In order to suppress such screw-pitch shaped density unevenness, it is necessary to sufficiently charge the supplied toner in the agitating and conveying screw.

Thus, in the embodiment, the contact force of the carrier of the two-component developer and the toner as well as the frictional force are controlled, which allows the toner electrification amount in the screw to be relatively large. The contact force of the carrier and the toner as well as the frictional force can be represented by a developer load Wd which is determined from the torque T, the rotation angle speed R, and the amount of the developer for each of the agitating and conveying screws 41 and 42 of the development apparatus and the developing sleeve 40. The developer load Wd corresponds to the saturated toner electrification amount.

When the toner electrification amount by rotation of the agitating and conveying screw is relatively large, a ratio represented by (developer load on the developing sleeve)/(average developer load on the agitating and conveying screw)

has a smaller value.

Here, it is found that a good image without the screw-pitch shaped density unevenness can be obtained by using the structure which satisfies the following relation from experimental results as described below.

That is, in developing, dynamic torques (gf·m) are Ts, T1, and T2, respectively, and rotation angle speeds (rad/s) are Rs, R1, and R2, respectively, at the time of rotations of the developing sleeve 40, the first agitating and conveying screw 41, and the second agitating and conveying screw 42.

Figure 3:
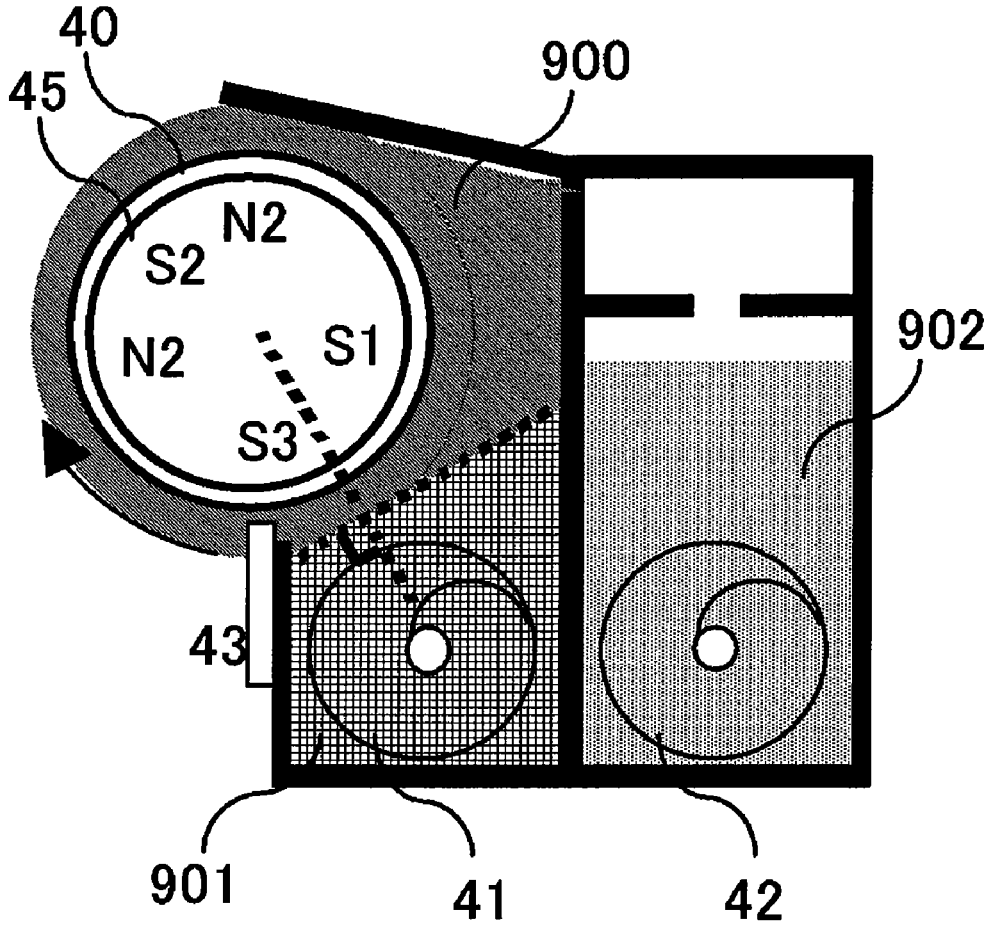
FIG. 3 is a outline cross-sectional view illustrating the location of a developer amount which is needed to measure a load Wd.

Further, the mass (g) of the developer housed in the second agitating chamber 902 is M2. As shown in FIG. 3, spaces formed by the developing chamber 900 and the first agitating chamber 901 are divided by a line running at right angles to a central point which equally divides the distance between two points in which a line segment passing through shaft centers of the developing sleeve 40 and the first agitating and conveying screw 41 intersects with the outer diameters of the developing sleeve 40 and the screw 41. The mass (g) of the developer which is present in the space of the side of the developer bearing member of the divided spaces, namely, the space of the side of the developing sleeve 40 is Ms. On the other hand, the mass (g) of the developer which is present in the space of the side of the first conveying member, namely, the space of the side of the first agitating and conveying screw 41 is M1. Further, G is the conversion factor from N to kpf (1kgp-G×1N).

A developer load Wds (mW/g) on the developer conveyed by rotation of the developing sleeve 40 is defined as Wds (mW/g)=Rs×Ts×G/Ms.

In the same manner as described above, a developer load Wd1 (mW/g) on the developer conveyed by rotation of the first agitating and conveying screw 41 is defined as Wd1 (mW/g)=R1×T1×G/M1.

In the same manner as described above, a developer load Wd2 (mW/g) on the developer conveyed by rotation of the second agitating and conveying screw 42 is defined as Wd2 (mW/g)=R2×T2×G/M2.

In the case, when the relation of $0.5<Wds/(Wd1+Wd2)\leqq 7.0$ Equation (1);

$12.5\leqq Wds\leqq 57.5$ Equation (2); and $Wd1<Wd2$ Equation (3)

is satisfied, a good image without the screw-pitch shaped density unevenness can be produced.

The rewritten Equation (1) is as follows:

$$1<Wds/\{(Wd1+Wd2)/2\}<14 \quad \text{Equation (1)'}$$

The denominator is an average developer load of two screws. Equation (1) shows that a ratio of the developer load of the screws to the developer load of the developing sleeve is larger than 1 and less than or equal to 14 as a whole.

In conventional development apparatuses which cause screw pitch unevenness, the developer load Wds in the developing sleeve was around 50 (mW/g) and developer loads Wd1 and Wd2 in the screws were around 1.0 (mW/g).

Figure 4:
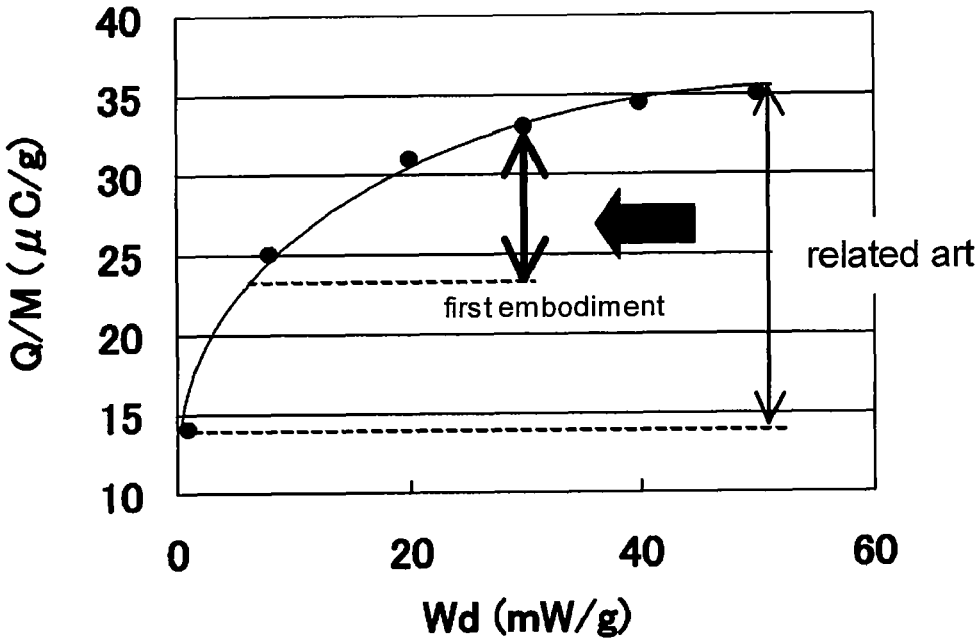
FIG. 4 is a graph illustrating the relation between the load Wd on the developer and the toner electrification amount Q/M.

The relation of the load Wd on the developer and the toner electrification amount Q/M is shown in FIG. 4. As is apparent from FIG. 4, the toner electrification amount Q/M is 35 (μC/g) when the load of the developing sleeve is Wd=50. When the load of the screw is Wd=1.0, the Q/M is 14 (μC/g). That is, it is found that a difference (21 μC/g) in the toner electrification amount between the developing sleeve and the agitating and conveying screw is produced.

As described above, screw pitch unevenness is caused by in the difference in the toner electrification amount Q/M due to the difference of the load on the developer in the screw and the developing sleeve. It can be understood that screw pitch unevenness can be prevented by reducing the Q/M difference.

In the structure that the developer load Wds in the developing sleeve is further increased, screw pitch unevenness is not generated. This is because the difference in the unevenness of the toner electrification amount Q/M by the agitating and conveying screw and the developing sleeve is forcibly reduced by applying a larger load to the developing sleeve and screw pitch unevenness is eliminated. However, in the structure, the energy which does not contribute to an increase in the toner electrification amount is applied to the developer in large amounts. Thus, the degradation of the developer becomes remarkable.

In the embodiment, the compression by the agitating and conveying screw is relatively enhanced to reduce the unevenness of the toner electrification amount Q/M and an electric charge is applied to the toner in advance when the compression of the developer in the developing sleeve is weakened. Variations in the toner electrification amount on the developing sleeve are reduced and screw pitch unevenness is not generated by introducing the structure.

When experiments were performed and examined, it was found that good images without the screw-pitch shaped density unevenness could be obtained by the structure satisfying the relation of Equations (1) to (3).

(Method of Determination of Parameters)

Here, a measuring method of a rotating torque T and a mass of developer M required for calculation of the developer load Wd (mW/g) which is a characteristic parameter represented by the equations will be described.

First, a method for measuring the torque of rotating members of the developing sleeve 40 and the second agitating and conveying screws 41 and 42 will be described. In measuring these torques, when each of the rotating members are drive-connected by a gear, the drive connection is disengaged so as to make them free. The rotating members of the developing sleeve 40 and the first and second agitating and conveying screws 41 and 42 of the development apparatus are driven at a predetermined number of rotations with nothing left in the development apparatus, namely, without placing the developer into it. Then, a torque Te for each of the rotating members is measured.

Subsequently, the developer with a predetermined mass is placed into the development apparatus. The torque Tx (gf·m) for each of the rotating members of the development apparatus is determined while the development apparatus is driven at a predetermined rotation angle speed (rad/s). The dynamic torques to the developer in each of the rotating members are found by subtracting the torque Te from the torque Tx. These values are the torques Ts, T1, and T2 as described above.

Subsequently, when the masses Ms, M1, and M2 (g) of a subject developer is determined, the amount of the developer which is present in a region of the second agitating chamber 902 in FIG. 3. is measured. The resulting mass is designated as M2. Further, the spaces formed by the developing chamber 900 and the first agitating chamber 901 are divided as described above. Then, the amount of the developer which is present in the side of the developing sleeve 40 is measured. The resulting mass is designated as Ms. The amount of the developer which is present in the side of the first agitating and conveying screw 41 is measured. The resulting mass is designated as M1.

The developer load Wd is calculated using the torque T and the mass of developer M thus determined and the rotation angle speed R which can be found from a predetermined number of rotations.

(Experimental Results)

Hereinafter, basis for Equations (1) to (3) will be described with reference to experimental results.

Figure 2:
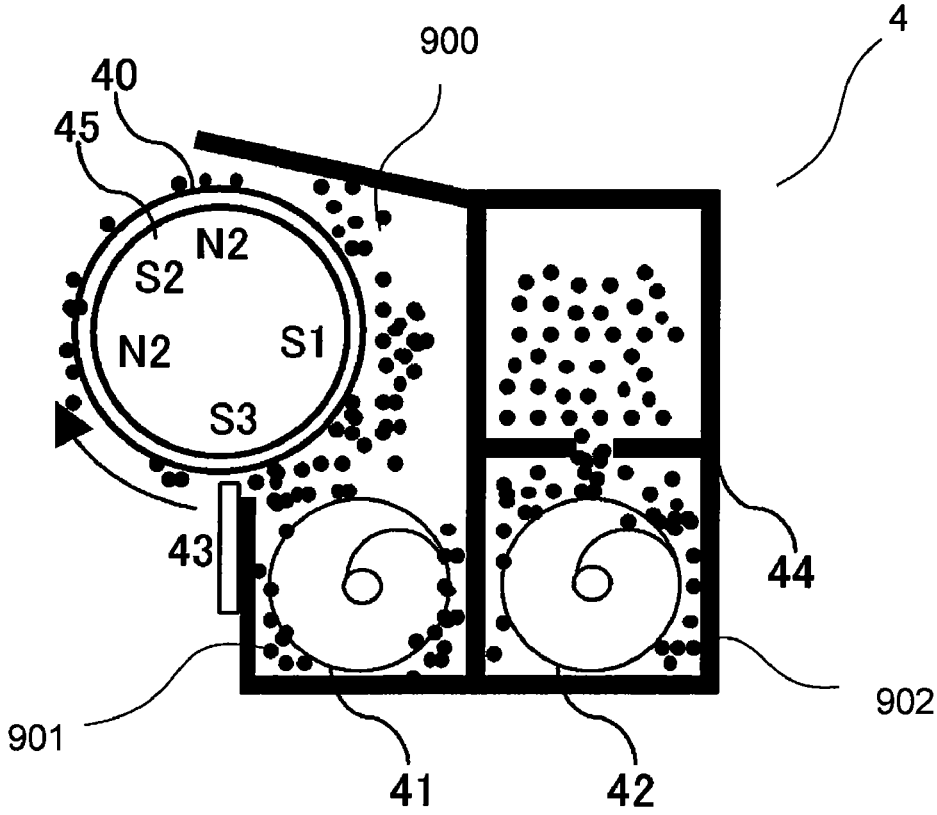
FIG. 2 is an outline cross-sectional view illustrating one embodiment of the development apparatus according to the first embodiment.

The development apparatus of the embodiment has a ceiling of the second agitating chamber 902 which is relatively low as shown in FIG. 2. When the amount of the developer is increased, the conveyance of the developer is slightly limited. On the other hand, the interaction between developer particles is enhanced. In the development apparatus, the developer loads Wd1 and Wd2 were changed by varying the mass of the developer, the longitudinal size and structure of the regulation wall, and the agitating and conveying screw pitch. Further, the developer load Wds is changed by varying the magnetic field strength of the S3 pole of the developing sleeve 40, which is examined. A black colored image was continuously outputted to 1,000 sheets of A3 paper and the generated screw pitch unevenness at the time was examined.

(Basis for Equation (2))

Results when Wd1, Wd2, and Wds are changed are shown in FIG. 5. A combination of the developer loads Wd1 and Wd2 of the first and second agitating and conveying screws 41 and 42 is used in Conditions 1-1 to 1-22. The value of the developer load Wds of the developing sleeve 40 is changed based on the combination. The numbers in the table shown in FIG. 5 are values of Wds/(Wd1+Wd2) which are previously focused and the evaluation of the outputted images is represented by the marks.

In all conditions, when the Wds was less than 12.5 (mW/g), the strength of the magnetic pole embedded in the developing sleeve 40 was not sufficient. An image defect due to the unevenness of the amount of developing sleeve coating was observed. Further, in all conditions, when the Wds exceeded 57.5 (mW/g) and was equal to 60 (mW/g), the degradation of the developer was significant. The so-called "fog", a phenomenon in which a little toner is transferred to a white portion, was generated on a margin in the last half of duration.

Thus, it is found that the Wds (as shown in Equation (2)) needs to be 12.5 (mW/g) or more and 57.5 (mW/g) or less.

(Basis for Equation (1))

Hereinafter, results supporting basis for Equation (1) will be described. First, results of Conditions 1-3 to 1-8 are described. Conditions 1-3 to 1-8 show the results when the developer load Wd2 of the agitating and conveying screw 42 is increased while the developer load Wd1 of the agitating and conveying screw 41 is fixed to 1.0. Conventionally, as for the values of Wd1 and Wd2, the value of about 1 (mW/g) has been employed in many cases. Therefore, the values of Wd1 and Wd2 were finely divided and examined.

When the Wds was 12.5 and 15 (mW/g) in Condition 1-3, a good image could be obtained. In that case, the values of Wds/(Wd1+Wd2) were 5 and 6, respectively. However, when Wds was 20 (mW/g) or more, screw pitch unevenness was generated. In the case of Wds=20 (mW/g), the value of Wds/(Wd1+Wd2) was 8.

In Condition 1-4, good images could be produced until when the Wds was 20 (mW/g). In that case, the value of Wds/(Wd1+Wd2) was 6.7. Further, when the Wds was 35 (mW/g) or more, screw pitch unevenness was generated. In the case of Wds=35 (mW/g), the value of Wds/(Wd1+Wd2) was 11.7.

As described above, the relation between the value of Wds/(Wd1+Wd2) and screw pitch unevenness in Conditions 1-3 to 1-8 is compared. Thus, it was found that screw pitch unevenness was not generated and good images could obtained when the value of Wds/(Wd1+Wd2) was about 7 or less.

The results of Conditions 1-9 to 1-13 will be described. Conditions 1-9 to 1-13 show the results when the values of Wd1 and Wd2 are increased while the relation where the Wd1 is larger by 1 than the Wd2.

In Condition 1-9, good images could be obtained until when Wds was 35 (mW/g). In that case, the value of Wds/(Wd1+Wd2) was 7. Further, when the Wds was 50 (mW/g) or more, screw pitch unevenness was generated. In the case of Wds=50 (mW/g), the value of Wds/(Wd1+Wd2) was 10 and screw pitch unevenness was generated.

In Conditions 1-11 to 1-13, there was no case where the value of Wds/(Wd1+Wd2) was 7 or more. Thus, screw pitch unevenness was not generated. However, as the case where Wds is 10 or 12.5 in Condition 1-13, the structure in which the amount of the developer load by the screw and the developing sleeve is reversed, namely, the condition of Wds/(Wd1+Wd2) <0.5 could not be realized in the embodiment.

As described above, it is found that the ratio of the toner electrification given by the screw and the developing sleeve is made to be a proper value, screw pitch unevenness is eliminated, and a good image is maintained by satisfying Equation (1).

(Basis for Equation (3))

Hereinafter, results supporting basis for Equation (3) will be described. Here, attention is focused on Conditions 1-1 and 1-2 which show the results when the Wd1 is fixed to 1.0 (mW/g) and the Wd2 is 0.5 (mW/g) or 1.0 (mW/g). In Condition 1-1, the value of Wds/(Wd1+Wd2) is 7 or more in the relation of $12.5 \leqq Wd \leqq 57.5$ where a poor developing sleeve coating is not produced. Thus, Equation (1) can not be satisfied and screw pitch unevenness is generated. Subsequently, in Condition 1-2, the value of Wds/(Wd1+Wd2) is 6.3 when the Wds is 12.5 (mW/g). Although the value is smaller than 7, screw pitch unevenness is generated. However, in Conditions 1-3 to 1-4 where Wd2 is larger than Wd1, screw pitch unevenness is not generated in the range of Wds/(Wd1+Wd2)<8.

In the same manner as described above, Conditions 1-19 to 1-22 show the results when the Wd1 is fixed to 28.0 (mW/g) and the value of Wd2 is increased by 1.0 (mW/g) from 27.0 (mW/g). In Conditions 1-19 and 1-20 where the Wd2 is smaller than the Wd1, screw pitch unevenness is generated despite the fact that the value of Wds/(Wd1+Wd2) is smaller than 7. However, screw pitch unevenness is not generated in Conditions 1-21 and 1-22 where the Wd2 is larger than the Wd1.

In order to confirm the result again, the values of Wd1 and Wd2 were increased while the relation where the Wd1 was larger by 1 than the Wd2 in Conditions 1-14 to 1-18. In all conditions, screw pitch unevenness was generated regardless of the value of Wds/(Wd1+Wd2).

As described above, it is required that Wd2 is larger than Wd1. Namely, the condition of Wd1<Wd2 that is Equation (3) is needed.

This is because charging of the supplied toner is greatly affected by a sufficient changing in the agitating chamber. Consequently, it is demonstrate that a sufficient charging is necessary to prevent screw pitch unevenness before the toner is flown into the developing chamber.

From the above experimental results, it found out that it is necessary to satisfy Equations (1) to (3) at the same time in order to obtain a good image without screw pitch unevenness at the time of durability of the black-colored image.

As a typical example of the embodiment, the case where the developer loads by the developing sleeve 40 and the second agitating and conveying screws 41 and 42 are Wds=30.0 (mW/g), Wd1=7.1 (mW/g), and Wd2=7.3 (mW/g), respectively, was examined once again. When calculation is performed using these values, Equation (1) is Wds/(Wd1+Wd2)=3.5. Therefore, it is found that the three previous equations are satisfied.

As shown in FIG. 4, the toner electrification amount Q/M given by the developing sleeve 40 of the development apparatus in the embodiment is 33 (1C/g) and the toner electrification amount Q/M given by the screw is 24 (μC/g). The difference between them is only 9 (μC/g). Examination was carried out using the development apparatus and it was confirmed that screw pitch unevenness was not generated and good images could be maintained at the time of durability. As compared with the fact that the difference of the toner electrification amount Q/M was 21 (μC/g) in a conventional structure, it could be confirmed that screw pitch unevenness was not generated when the difference was reduced. Since the developer load in the developing sleeve 40 is small, the total developer was less degraded and good images could be maintained.

Second Embodiment

Subsequently, the apparatus according to the second embodiment will be described with reference to FIGS. 6 and 7. In this regard, a basic constitution of the apparatus in the embodiment is the same as that of the above-described embodiment and description will not be repeated here. Characteristic structures of the embodiment will be herein described. In addition, the same numeral references are applied to the members having the same function as that of the embodiment.

Figure 6:
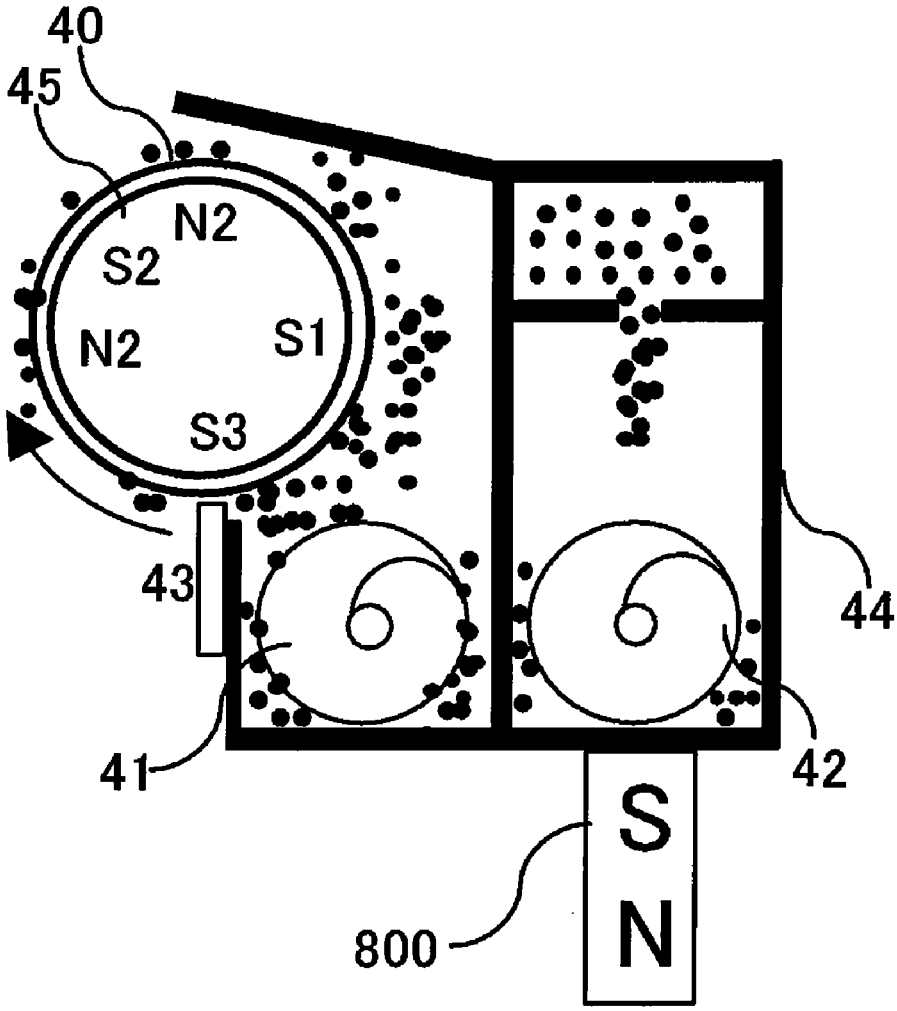
FIG. 6 is an outline cross-sectional view illustrating one embodiment of the development apparatus according to a second embodiment.
Figure 7:
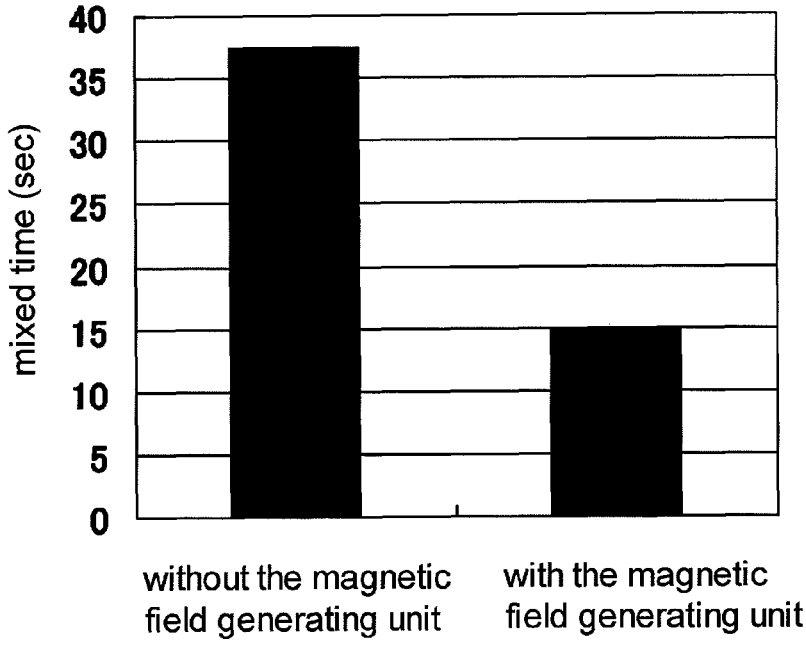
FIG. 7 is a bar graph illustrating time taken to mix a supplied toner with or without the magnetic field generating unit in the embodiment of the development apparatus.
Figure 9:
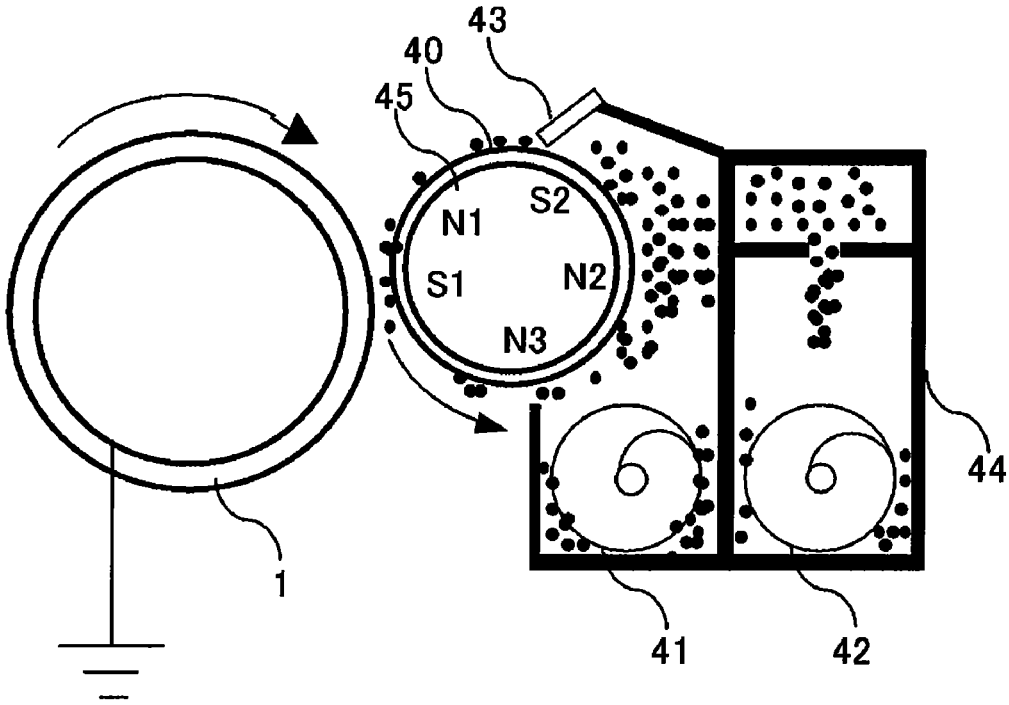
FIG. 9 is a schematic diagram illustrating one embodiment of the conventional art.

One of the characteristics of the embodiment is that a magnetic field generating unit 800 is provided at the second agitating chamber 902, namely, the outside of the second chamber (bottom portion of the agitating chamber in the embodiment) as shown in FIG. 6 in order to increase a developer load Wd2 by the second agitating and conveying screw 42. A peak value of the magnetic field strength at the lower end of the agitating chamber by the magnetic field generating unit 800 is desirably 200 gauss or more and 1,000 gauss or less.

The interaction between developer particles is enhanced by applying the magnetic field to the second agitating chamber 902. As a result, the interaction between the developer and the agitating and conveying screw is increased, and thus the load Wd2 on the developer can be largely reduced.

Further, the mixing property of the supplied toner is improved by providing the magnetic field generating unit 800 directly below the second agitating and conveying screw 42. This is because the magnetic carrier in the developer forms a magnetic chain and an area of contact between the supplied toner and the developer surface is increased. The mixed time of the supplied toner was visually measured. As shown in FIG. 7, the mixed time in the embodiment where the magnetic field generating unit 800 is provided was shortened to about 1/2.5 as compared with the mixed time when the magnetic field generating unit 800 is not provided.

The result of the study in the embodiment is illustrated in FIG. 8. The development apparatus with the magnetic field generating unit and the development apparatus without the magnetic field generating unit were set to Wds=30, Wd1=2.0, and Wd2=3.0 by adjusting the magnetic field strength in the amount of the developer and the lower end of the agitating chamber. That is, the development apparatus was set to Wds/(Wd1+Wd2)=6.0 and the duration of the black colored image was examined.

As a result, good images without screw pitch were obtained by the development apparatus with the magnetic field generating unit and the development apparatus without the magnetic field generating unit. However, fog was generated in the case of the development apparatus without the magnetic field generating unit when the number to be developed exceeded 30,000 sheets. This is because the mobility of supplied toner is deteriorated by the degradation of the developer and fog is caused by mixing defects. On the other hand, good images could be obtained in the case of the development apparatus with the magnetic field generating unit even when the number to be developed exceeded 50,000 sheets.

In the embodiment, when the magnetic field generating unit is installed, a uniform black-colored image having the shape of a screw pitch without density unevenness was produced and the mixing property of supplied toner was also improved. Thus, fog caused by mixing defects of supplied toner at the time of durability could be reduced and a further long life of the developer could be realized.

In the present invention, the uniform black-colored image without the screw-pitch shaped density unevenness can be obtained even when the load in the developer bearing member is decreased for the purpose of giving the developer a longer life.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-184588, filed Jul. 13, 2007, which is hereby incorporated by reference herein in its entirety.

What is claimed is:

1. A development apparatus which develops an electrostatic image formed on an image bearing member with a developer comprising:

a developing container having a first chamber and a second chamber which communicates with the first chamber and to which a developer to be fed is supplied;

a developer bearing member which is rotatably provided in the first chamber and feeds the developer to the image bearing member;

a regulation member disposed against the developer bearing member, for regulating a layer thickness of the developer on the developer bearing member;

a first conveying member which is rotatably provided in the first chamber and conveys the developer in the first chamber; and a second conveying member which is rotatably provided in the second chamber and conveys the developer in the second chamber to the first chamber, wherein a frame of the developing container having the first chamber and the second chamber is formed so as to satisfy the following relationships:

$$0.5<Wds/(Wd1+Wd2)7.0,$$

$$12.5Wds\leqq 57.5, \text{ and}$$

$$Wd1<Wd2$$

where Wds, Wd1, and Wd2 are defined, as follows:

$Wds(W/kg)=Rs\times Ts\times G/Ms$, $Wd1\ (W/kg)=R1\times T1\times G/M1$, and $Wd2\ (W/kg)=R2\times T2G/M2$, Ts is a dynamic torque (kgf·m) of the developer bearing member, T1 is a dynamic torque (kg·fm) of the first conveying member, T2 is a dynamic torque (kg·fm) of the second conveying member, Rs is a rotation angle speed (rad/s) of the developer bearing member, R1 is a rotation angle speed (rad/s) of the first conveying member, R2 is a rotation angle speed (rad/s) of the second conveying member, and wherein when the first chamber is divided by a perpendicular bisector which bisects a line connecting the most nearest points of the developer bearing member and the first conveying member:

Ms is a mass (kg) of the developer which is present in a space of a side of the developer bearing member, M1 is a mass (kg) of the developer which is present in a space of a side of the first conveying member, M2 is a mass (kg) of the developer housed in the second chamber, and 1 (kgf)=G×1 (N).

2. The development apparatus which develops an electrostatic image formed on an image bearing member with a developer according to claim 1, wherein a magnetic field generating unit which increases the load on the developer Wd2 is provided at an external portion of the second chamber.

3. The development apparatus which develops an electrostatic image formed on an image bearing member with a developer according to claim 1, wherein the developer in the second chamber is carried so as to be contacting with a ceiling of the second chamber.

* * * * *